US006840329B2

(12) United States Patent
Kikuchi et al.

(10) Patent No.: US 6,840,329 B2
(45) Date of Patent: Jan. 11, 2005

(54) COVER ASSEMBLY FOR A CONCEALED SPRINKLER HEAD

(75) Inventors: Tetsuro Kikuchi, Iwate-ken (JP); Hiroki Ishikawa, Iwate-ken (JP); Yasuaki Koiwa, Iwate-ken (JP)

(73) Assignee: Senju Sprinkler Company Limited, Tokyo (JP)

( * ) Notice: Subject to any disclaimer, the term of this patent is extended or adjusted under 35 U.S.C. 154(b) by 141 days.

(21) Appl. No.: 10/379,546

(22) Filed: Mar. 6, 2003

(65) Prior Publication Data

US 2003/0196821 A1 Oct. 23, 2003

(30) Foreign Application Priority Data

Mar. 6, 2002 (JP) ..... 2002-059621
Sep. 24, 2002 (JP) ..... 2002-276849

(51) Int. Cl.[7] ..... A62C 37/08; A62C 37/12

(52) U.S. Cl. ..... 169/37; 169/38; 169/56; 169/57

(58) Field of Search ..... 169/37, 38, 56, 169/57, 59

(56) References Cited

U.S. PATENT DOCUMENTS 3,998,273 A 12/1976 Juliano
4,014,388 A 3/1977 Anderson
4,105,076 A 8/1978 Simons et al.
5,117,916 A * 6/1992 Ohta et al. ..... 169/37
5,372,203 A * 12/1994 Galaszewski ..... 169/37
6,484,809 B1 * 11/2002 Elder ..... 169/37

FOREIGN PATENT DOCUMENTS

JP 3016985 8/1995
JP 9-187529 7/1997
JP 2000-157642 6/2000

* cited by examiner

*Primary Examiner*—Robin O. Evans
(74) *Attorney, Agent, or Firm*—Wenderoth, Lind & Ponack, L.L.P.

(57) ABSTRACT

A concealed sprinkler head is mounted above the ceiling of a fire protected zone. The sprinkler head includes a housing within which a valve and other operative parts are contained. A decorative cover plate is secured to the housing to conceal the sprinkler head within the ceiling so that none of the operative parts is visible. The cover assembly includes a thin metallic cover plate made of a heat conductive material such as copper, and a metallic skirt including a cylindrical wall threaded on the housing, an annular flange extending outwardly from one end of the cylindrical wall, and a plurality of tabs extending downwardly from the flange. A plurality of heat insulative elements are disposed between the tabs and the cover plate. A metallic layer is attached to the lower surface of each of the insulative elements. A layer of fusible material is disposed between the metallic layer and the cover plate to secure each of the insulative elements to the cover plate through the metallic layer.

17 Claims, 7 Drawing Sheets

COVER ASSEMBLY FOR A CONCEALED SPRINKLER HEAD

BACKGROUND OF THE INVENTION

The present invention relates generally to automatic sprinkler heads and more particularly, to a decorative cover assembly adapted to conceal a pendent sprinkler head within the ceiling of a fire protected enclosure.

Sprinkler systems are used extensively to provide automatic fire protection for residential, commercial and public buildings. There are two types of pendent sprinkler heads for ceiling applications, one referred to by the term "concealed" and the other referred to by the term "flush". A concealed sprinkler head has its entire body located above the lower surface of the ceiling of an enclosure in which it is installed. A flush sprinkler head has the majority of its body located above the lower surface of the ceiling, but a thermally responsive element and its related elements are partly or wholly located below the ceiling. Thus, the concealed sprinkler head is less obstructive and more aesthetical than the flush sprinkler head.

U.S. Pat. No. 4,014,388 issued to Anderson discloses a concealed sprinkler head wherein a cylindrical housing is located above the ceiling of a fire protected enclosure and surrounds a thermally responsive element and all the other operative parts. A metallic cover plate is connected to the cylindrical housing through a metallic connecter ring and mounted flush against the ceiling so that none of the operative parts is visible. Solder is used to attach the metallic connector plate to the metallic connector ring. One problem arises with this arrangement. In the event of a fire, heat is readily transferred from the metallic cover plate through the solder to the metallic connector ring. As a result, the solder may not melt as quickly as it should be. This results in a reduction in the response time of the thermally responsive element.

U.S. Pat. No. 4,105,076 issued to Simons discloses a sleeve adapted to connect a cover plate to a cylindrical housing and made of a thermosetting resin or other heat insulating material. The sleeve has feet around which metal rings fit. The metal rings are attached to the cover plate by means of solder. The heat insulating material reduces the rate of heat transfer from the cover plate to the housing and facilitates melting of the solder. However, such a resinous sleeve is not durable.

Accordingly, it is an object of the present invention to provide a decorative cover assembly for a concealed sprinkler head, which is durable and can minimize the response time of the sprinkler head.

SUMMARY OF THE INVENTION

A concealed sprinkler head is mounted above the ceiling of a fire protected enclosure. The concealed sprinkler head includes a housing within which a valve and other operative parts are contained. A decorative cover assembly is secured to the housing to conceal the sprinkler head within the ceiling so that none of the operative parts is visible. According to the present invention, the decorative cover assembly includes a metallic cover plate made of a heat conductive material such as copper and copper alloy, and a metallic skirt including a substantially cylindrical wall, an annular flange extending outwardly from one end of the cylindrical wall, and a plurality of tabs extending generally downwardly from the flange. The cylindrical wall of the skirt is threaded on the cylindrical housing of the sprinkler head.

A plurality of heat insulative elements are disposed between the tabs and the cover plate. The upper surface of each of the insulative elements is adhesively attached or otherwise secured to a corresponding one of the tabs. A metallic layer is attached to the lower surface of the insulative element. A layer of low melting point fusible material or alloy is disposed between the metallic layer and the cover plate. Upon application of heat, the insulative element is secured to the cover plate through the metallic layer. The use of the heat insulative elements allows heat to be focused on the fusible alloy in the vent of a fire and facilitates melting of the fusible alloy and thus, release of the cover plate from the rest of the cover assembly.

In a preferred embodiment, the upper surface of the insulative elements may be secured to the tabs in a manner identical to the manner in which the lower surface of the insulative elements is secured to the tabs. To this end, a second metallic layer is attached to the upper surface of each of the insulative elements, and a second layer of low melting point fusible material or alloy is disposed between the second metallic layer and each of the tabs. A protective layer, made of a water resistant material such as wax, may surround the layers of fusible alloy, the metallic layers, the insulative elements and the tabs to prevent corrosion of the elements of the decorative cover assembly.

The upper end of the insulative elements may be secured to the tabs by mechanical means. In one embodiment, each of the tabs has a substantially vertical leg, and a foot extending outwardly from the lower end of the leg. Each of the insulative elements includes a rectangular plate and opposite side walls extending upwardly from opposite sides of the plate. The insulative element defines a space between the plate and the side walls to receive the foot of the tab. As an alternative, the foot of the tab has a recess, and the insulative element includes a plate and a projection formed on the plate. The projection is engageably received within the recess to secure the insulative element to the tab. Still alternatively, the foot of the tab has a circular opening. The insulative element includes a cylindrical shank and a head connected to one end of the shank. The shank is snugly fit in the opening to secure the insulative element to the tab. The insulative element may alternatively include a round base, and a semispherical head connected to the base with a diametrical slit. The semispherical head is inserted through the opening to secure the insulative element to the tab.

The cover plate may partly or wholly be made of a shape-memory alloy so that its peripheral edge may be bent in a downward direction when the ambient temperature reaches a predetermined level in the event of a fire. To increase the rigidity, a plurality of ribs may be formed in one side of the cover plate.

BRIEF DESCRIPTION OF THE DRAWINGS

The above and other features and advantages of the present invention will become more apparent from a reading of the following detailed description when taken in conjunction with the accompanying drawings, in which.

DETAILED DESCRIPTION OF THE INVENTION

Figure 1:
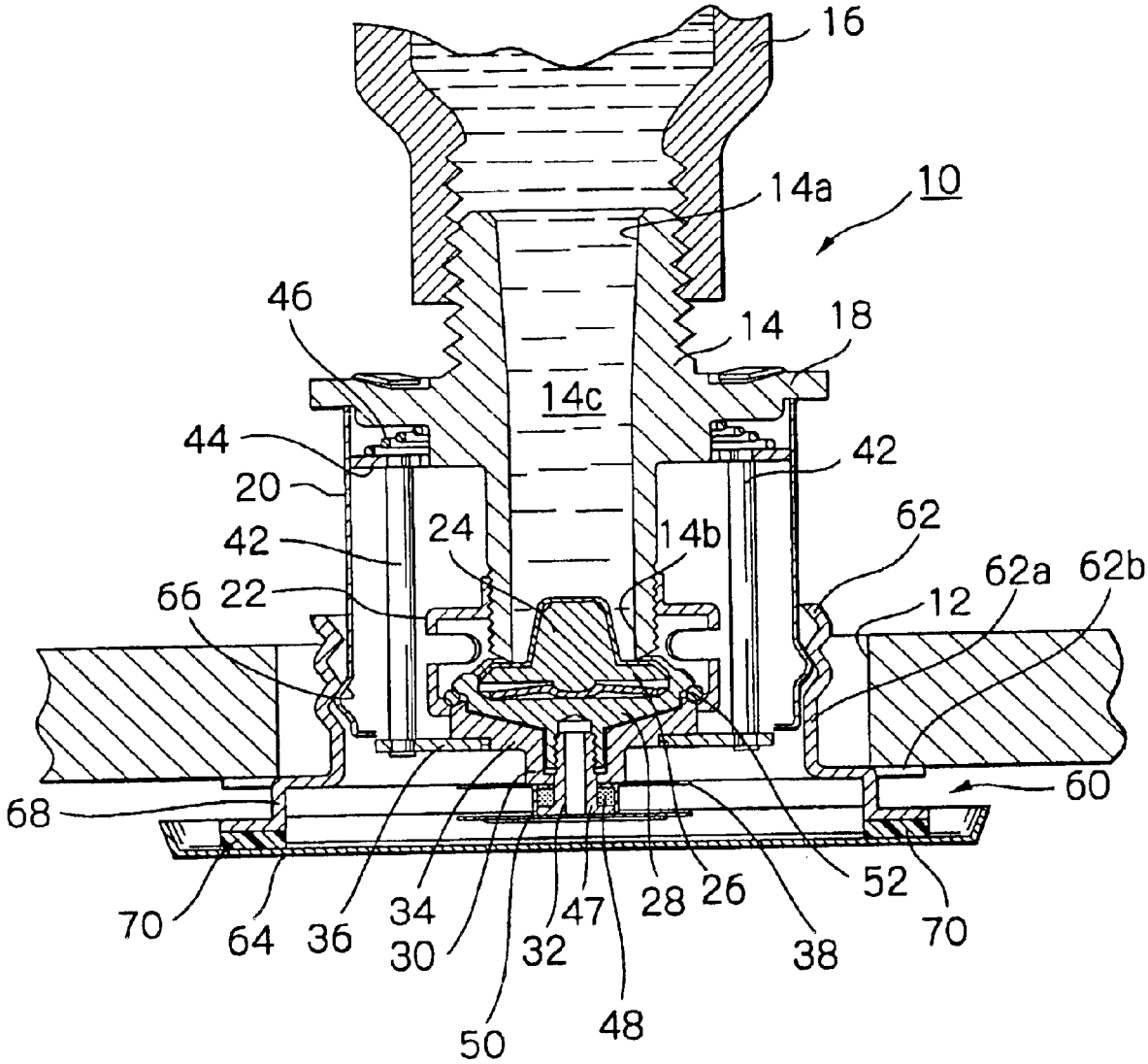
FIG. 1 is a vertical sectional view of a concealed sprinkler head mounted above the ceiling of a room and covered by a decorative cover assembly made according to one embodiment of the present invention.

Referring now to FIG. 1, there is illustrated a concealed sprinkler head, generally designated by the reference numeral 10, mounted in a hole 12 in the ceiling of a room such that the bottom of the sprinkler head is substantially flush with the ceiling.

In the illustrated embodiment, the sprinkler head 10 includes a vertically extending tubular body 14 with a threaded upper or inlet end 14*a* adapted to be connected to a water line 16, and a lower or outlet end 14*b*. The water line 16 is communicated with a supply of pressurized water or other fire extinguishing fluid (not shown). An internal passage 14*c* is defined in the tubular body 14 and extends between the inlet end 14*a* and the outlet end 14*b*. An annular flange 18 extends around the outer periphery of the tubular body 14 and is located midway between the inlet end 14*a* and the outlet end 14*b*. A generally cylindrical housing 20 depends from the annular flange 18. A generally cylindrical casing 22 is secured around the lower end of the tubular body 14 and is located within the housing 20.

The outlet end 14*b* of the tubular body 14 is normally closed by a valve assembly 24. The valve assembly 24 includes a valve element 26 normally seated on the outlet end 14*b* of the tubular body 14, and a valve holder 28 configured to hold the valve element 26. A deflector assembly 30 and a thermally responsive assembly 32 are operatively associated to normally urge the valve element 26 in its closed position. The deflector assembly 30 includes a deflector holder 34 located immediately below the valve assembly 24 and shaped to receive the valve holder 28. A deflector 36 is secured to the deflector holder 34. Also, an upper heat collector element or disk 38 is secured to the bottom of the deflector holder 34. As shown better in FIG. 2, the deflector 36 includes a plurality of tines 40 to alters the trajectory of water in an optimum pattern when the water is discharged from the outlet end 14*b* of the tubular body 14. A pair of diametrically opposite struts 42 are connected at their lower end to the deflector 36 and at their upper end to a guide ring 44. The guide ring 44 is slidably moved within the housing 20. A compression spring 46 is disposed between the lower surface of the flange 18 and the upper surface of the guide ring 44. The thermally responsive assembly 32 includes a fuse holder 47 secured to the valve holder 28 and adapted to hold a fusible alloy 48 therewithin. The fusible alloy 48 has a melting point of from 70° C. to 90° C. A lower heat collector disk 50 is secured to the bottom of the fuse holder 47. An annular ring 52 is located within the casing 22 and disposed between the valve holder 28 and the deflector holder 34.

A decorative cover assembly, designated generally by the reference numeral 60, is secured to the housing 20 to conceal the sprinkler head 10 within the ceiling. Illustratively, the decorative cover assembly 60 includes an annular skirt 62 secured around the housing 20 and a generally circular, thin cover plate 64 secured to the skirt 62. The skirt 62 has a helically corrugated cylindrical wall 62*a* and an annular flange 62*b* extending outwardly from the lower end of the cylindrical wall 62*a*. The skirt 62 is vertically adjustable by rotation of the skirt 62 relative to the housing 20. To this end, the housing 20 is formed on its outer peripheral surface with a plurality of conical projections 66 for engagement with the corrugated cylindrical wall 62*a* of the skirt 62. The conical projections 66 are arranged on a helical path around the circumference of the housing 20. The skirt 62 is threaded on the housing 20 until the flange 62*b* of the skirt 62 comes into engagement with the ceiling.

Figure 2:
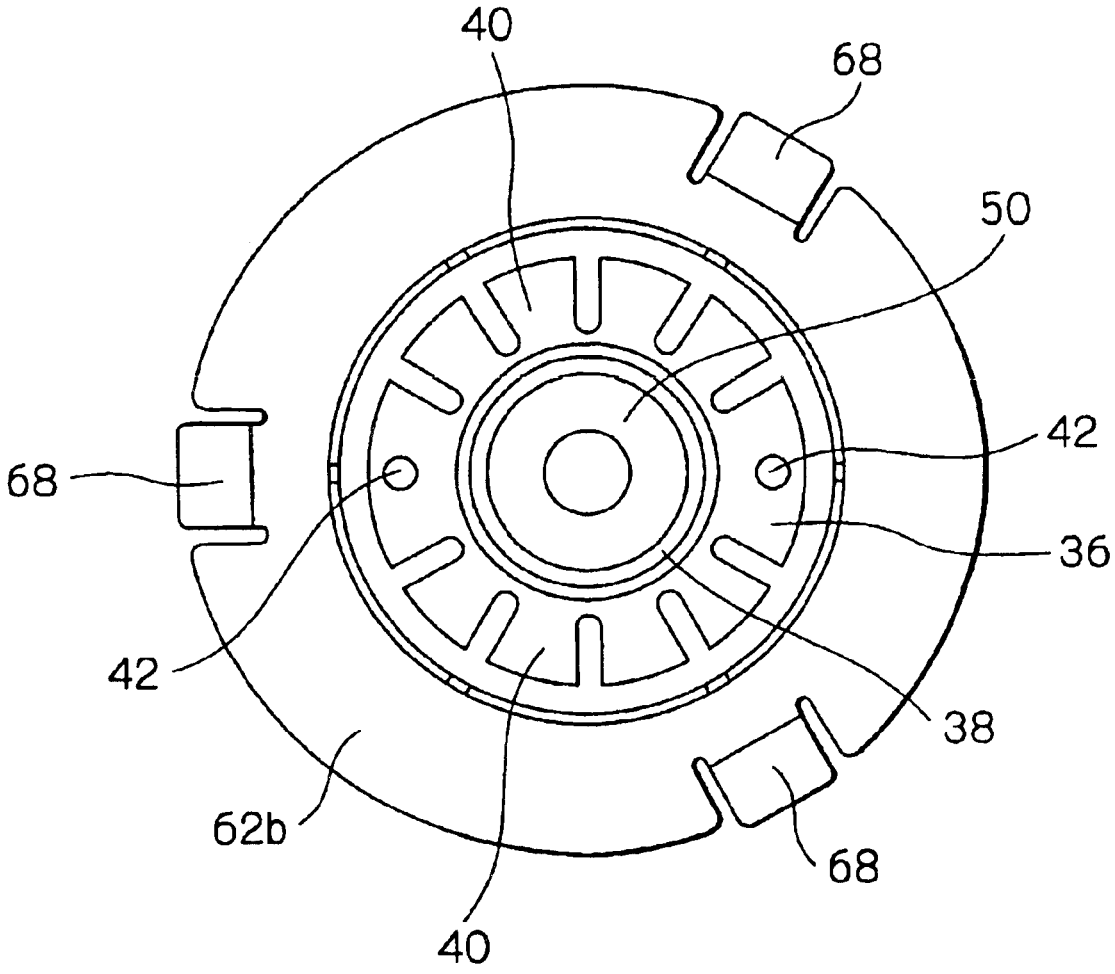
FIG. 2 is a bottom view of the sprinkler head with a cover plate removed for clarity.
Figure 3:
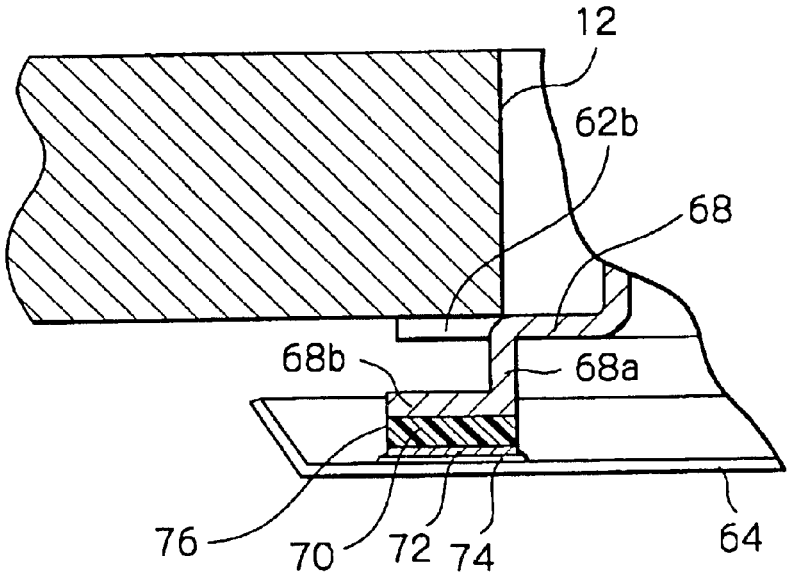
FIG. 3 is an enlarged section, in part, of the decorative cover assembly shown in FIG. 1.
Figure 4:
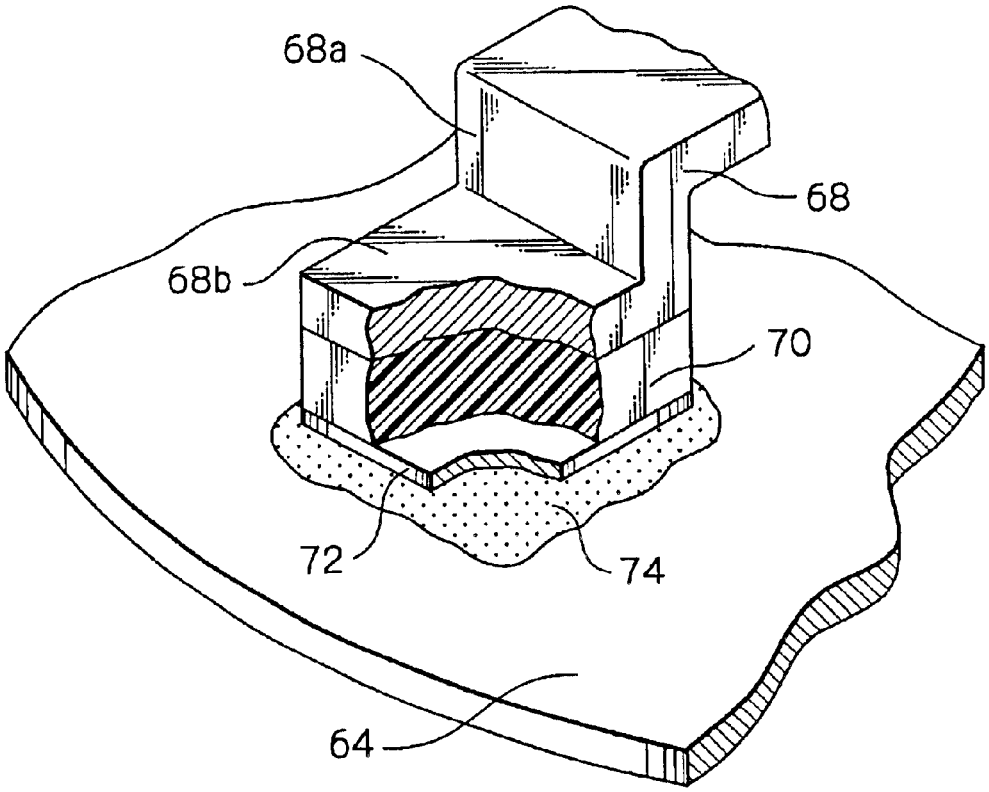
FIG. 4 is an enlarged perspective view, partly broken away, of the decorative cover assembly shown in FIG. 1.

Referring to FIGS. 2 to 4, three tabs 68 extend downwardly from the flange 62*b* and are spaced 120 degrees about the circumference of the flange 62*b*. Each of the tabs 68 has a substantially L-shape and includes a short leg 68*a* and a foot 68*b* extending radially outwardly from the lower end of the leg 68*a*. Three insulative elements 70 are disposed between the corresponding tabs 68 and the cover plate 64. More specifically, each of the insulative elements 70 is adhesively attached or otherwise secured to the lower surface of the foot 68*b* of each tab 68. The insulative element 70 has a thickness of approximately 1.0 mm and is made of a material with a low degree of heat conductivity, such as epoxy resin, phenolic resin, polyester resin and acrylic resin. A metallic layer 72 is adhesively attached or otherwise secured to the lower surface of the insulative element 70. The metallic layer 72 has a thickness of from 10 to 200 microns and is preferably made of copper or copper alloy to provide good solderability. The metallic layer 72 may alternatively be made of brass, bronze, gold, silver, nickel, tin and similar materials. The lower surface of the metallic layer 72 is coated first with flux and then, a layer of a low melting point fusible alloy 74. The layer of fusible alloy 74 has a thickness of from 20 to 200 microns and has a melting point of from 45° C. to 65° C. To ensure melting of the fusible alloy 74 before the fusible alloy 48 of the thermally responsive assembly 32 melts, the fusible alloy 74 should preferably have a lower melting point than the fusible alloy 48 of the thermally responsive assembly 32. Upon application of heat, the metallic layer 72 is soldered to the cover plate 64. The cover plate 64 is preferably made of copper, aluminum and similar materials to provide a high degree of heat conductivity. As shown best in FIG. 3, a protective layer 76 surrounds the insulative elements 70, the feet 68*b* of the tabs 68, the metallic layer 72 and the fusible alloy 74. The protective layer 76 is made of wax, fluoroplastic and similar water resistant materials to prevent corrosion.

Figure 5:
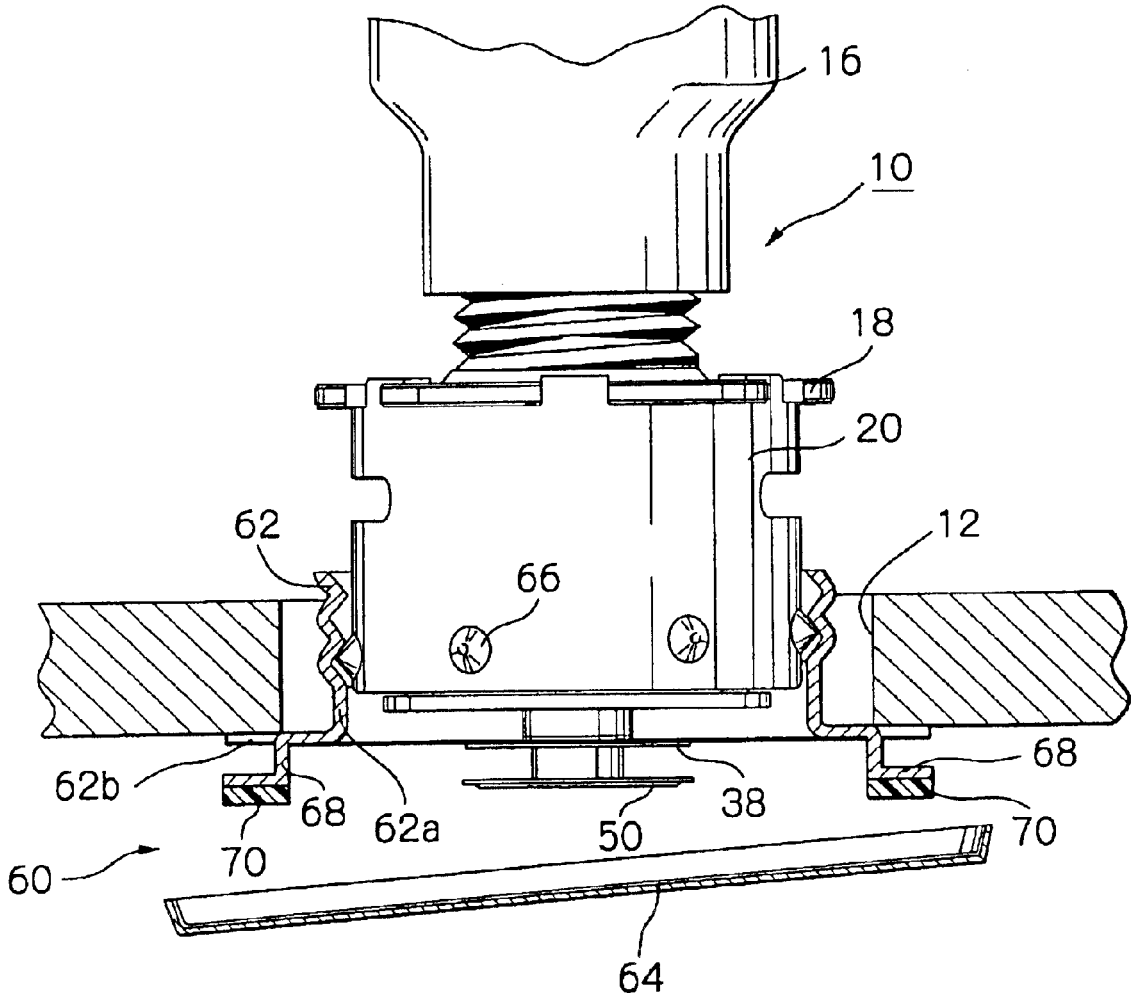
FIG. 5 shows the manner in which the cover plate is released from the rest of the decorative cover assembly in the event of a fire.

When the ambient temperature exceeds a predetermined value by the heat from a fire, the fusible alloy 74 melts. As shown in FIG. 5, this causes the cover plate 64 to be quickly released from the rest of the decorative cover assembly 60 since the use of the insulative elements 70 allows the heat to be focused on the fusible alloy 74 and retards heat transfer from the cover plate 64 to the annular skirt 62. Upon release of the cover plate 64, the thermally responsive assembly 32 is exposed to an elevated temperature where the fusible alloy 48 melts. Melting of the fusible alloy 48 causes the compression spring 46 to urge the deflector assembly 30 and thus, the annular ring 52 in a downward direction. As a result, the valve assembly 24 is released from the outlet end 14*b* of the tubular body 14. With the valve assembly 24 in its open position, water is discharged from the outlet end 14*b* of the tubular body 14. The water then strikes the deflector tines 40 and is deflected outwardly in the desired pattern.

Figure 6:
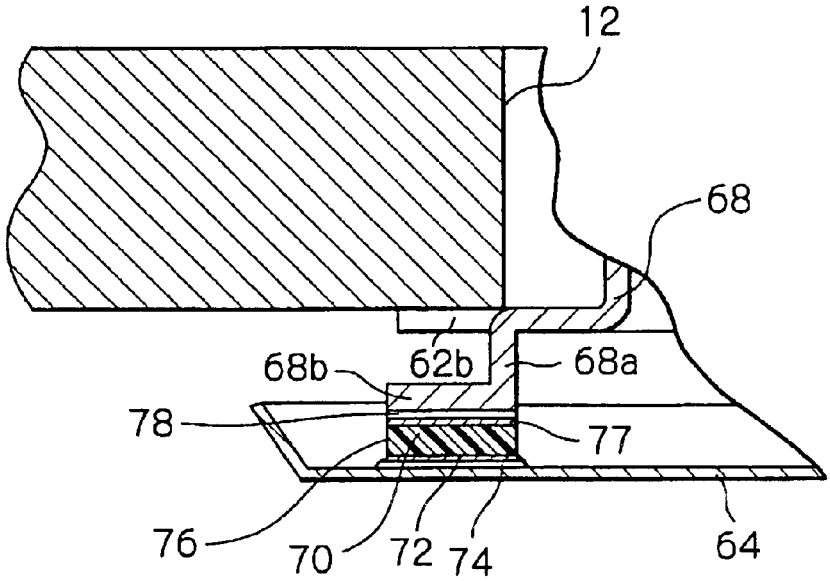
FIG. 6 is a view similar to that of FIG. 3, but showing a modified form of the decorative cover assembly.
Figure 7:
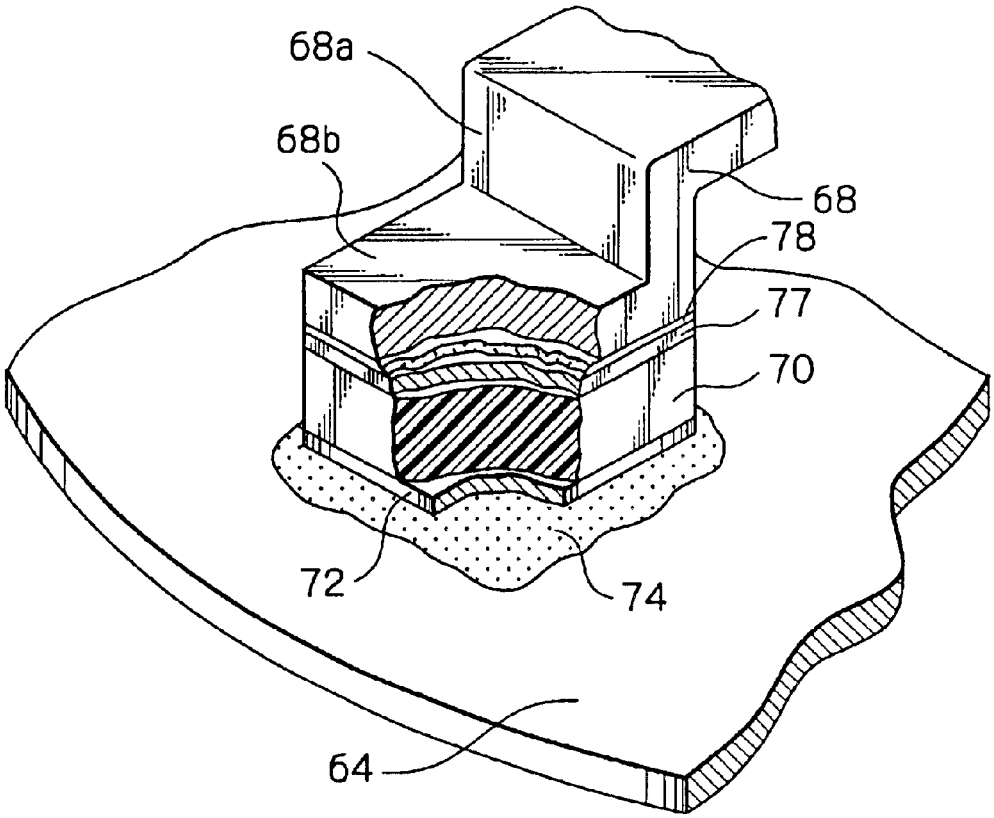
FIG. 7 is an enlarged perspective view, partly broken away, of the decorative cover assembly shown in FIG. 6.

Referring next to FIGS. 6 and 7 wherein like elements are given like reference numerals, there is illustrated a modified form of the decorative cover assembly according to the present invention. The lower surface of the insulative element 70 is secured to the cover plate 64 in the same manner as in the previous embodiment. In this alternative embodiment, the upper surface of the insulative embodiment 70 is secured to the corresponding tab 68 in a manner identical to the manner in which the lower surface of the insulative element 70 is secured to the cover plate 64. Specifically, a metallic layer 77 is attached to the upper surface of the insulative element 70. As in the metallic layer 72, the metallic layer 77 is preferably made of copper or copper alloy to provide good solderability. The upper surface of the metallic layer 77 is coated first with flux and then, a layer of fusible alloy 78. The fusible alloy 74 has a lower melting point than the fusible alloy 78. However, the fusible alloys 74, 78 may have the substantially same melting point. Upon melting of the fusible alloy 74, the cover plate 64 is released from the rest of the decorative cover assembly 60 in the same manner as in the previous embodiment.

Figure 8:
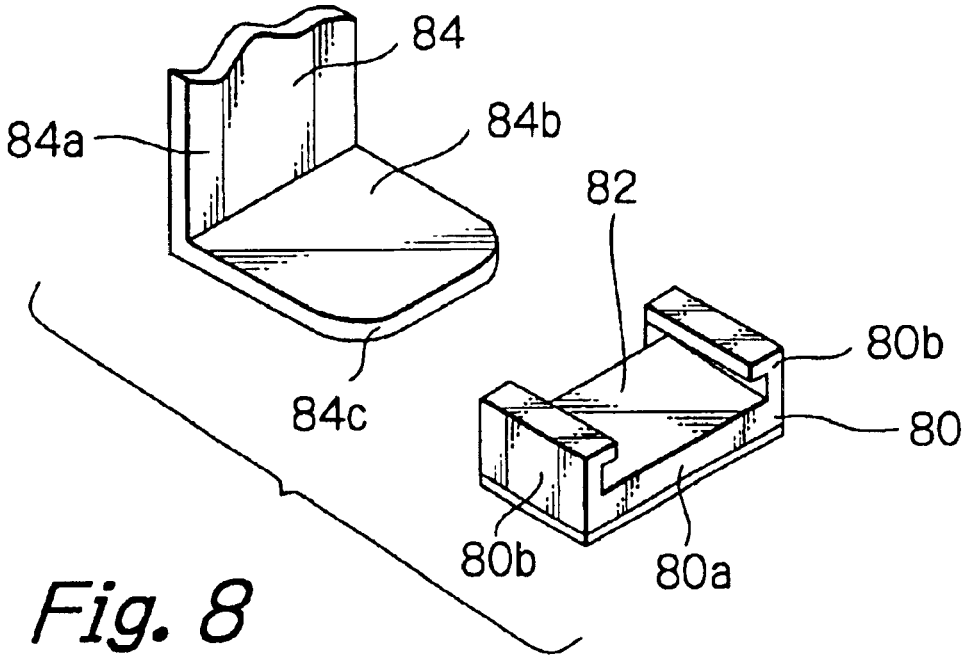
FIGS. 8 to 11 are perspective fragmentary views of further modified forms of the decorative cover assembly according to the present invention.

The insulative elements may be secured to the corresponding tabs by mechanical means as shown in FIGS. 8 to 11. As shown in FIG. 8, an insulative element 80 is composed of a rectangular plate 80*a* and opposite side walls 80*b* extending upwardly from opposite sides of the rectangular plate 80*a*. The side walls 80*b* have an inverted L-shape such that a space 82 is defined between the plate 80*a* and the side walls 80*b*. A tab 84 has a vertical leg 84*a* and a generally rectangular foot 84*b* extending horizontally from the lower end of the leg 84*a* and having a slightly round edge 84*c*. The foot 84*b* is inserted through the space 82 between the side walls 84*b* to mount the insulative element 80 to the tab 84. The lower surface of the insulative element 80 is secured to the cover plate (not shown in FIG. 8) in the same manner as in the embodiment shown in FIGS. 1 to 4.

Figure 9:
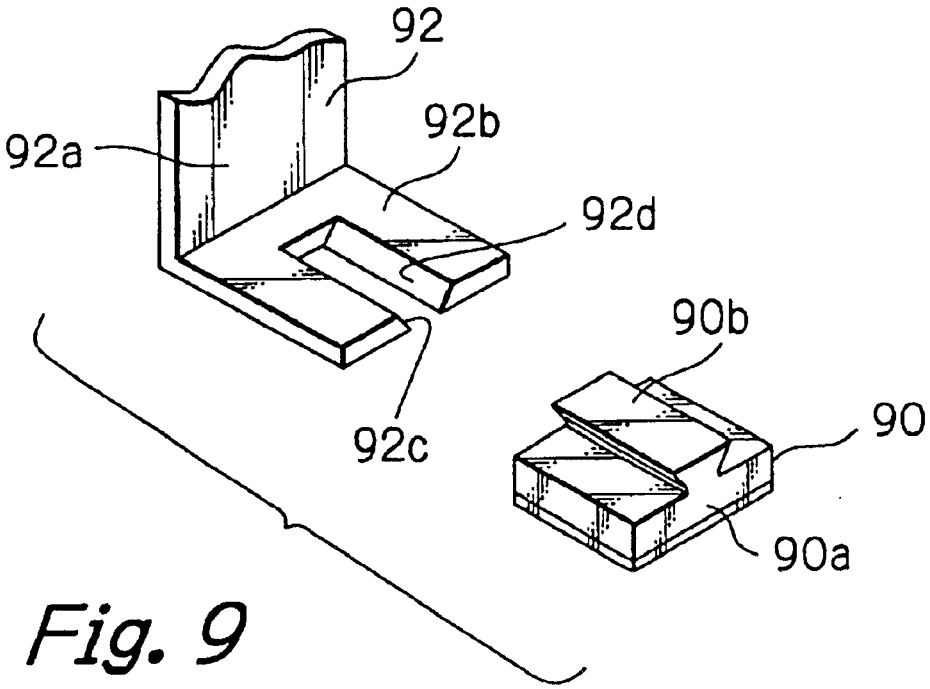

In the embodiment shown in FIG. 9, an insulative element 90 has a rectangular plate 90*a* and a generally triangular projection 90*b* formed on the plate 90*a* and extending along the length of the plate 90*a*. A tab 92 has a vertical leg 92*a* and a U-shaped foot 92*b* extending horizontally from the lower end of the leg 92*a*. A rectangular recess 92*c* is formed in the foot 92*b* and has opposite beveled sides 92*d*. The projection 90*b* of the insulative element 90 is inserted into the recess 92*c* to mount the insulative element 90 to the tab 92. The lower surface of the insulative element 90 is secured to the cover plate (not shown in FIG. 9) in the same manner as in the embodiment shown in FIGS. 1 to 4.

Figure 10:
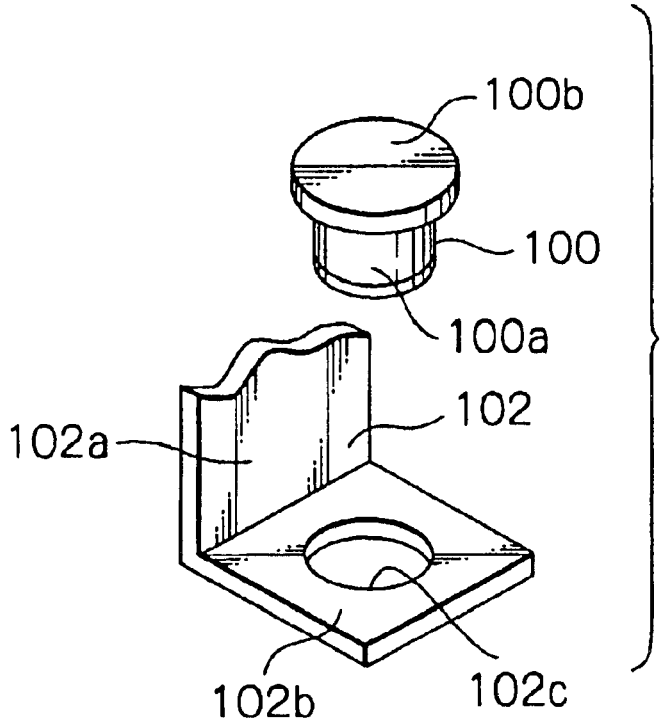

Turning to FIG. 10, an insulative element 100 is in the form of a bolt and has a cylindrical shank 100*a* and a circular flat head 100*b* connected to the upper end of the shank 100*a*. A tab 102 has a vertical leg 102*a* and a rectangular foot 102*b* extending horizontally from the lower end of the leg 102*a* and having a circular opening 102*c*. The outer diameter of the shank 100*a* is slightly greater than the inside diameter of the opening 102*c* so that the shank 100*a* is snugly fit into the opening 102*c*. The lower end of the shank 100*a* is secured to the cover plate (not shown in FIG. 10) in the same manner as in the embodiment shown in FIGS. 1 to 4.

Figure 11:
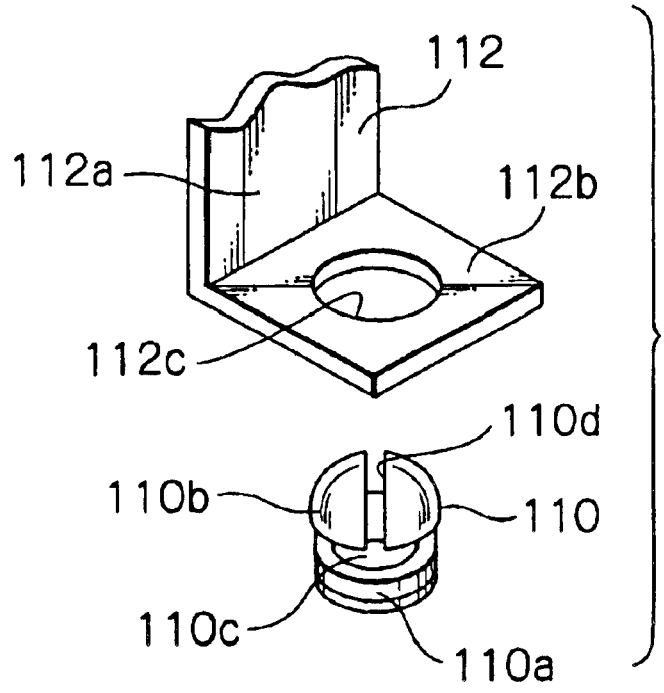

In FIG. 11, an insulative element 110 is composed of a round base 110*a*, and a semispherical head 110*b* connected to the round base 110*a* through a neck portion 110*c*. A diametrical slit 110*d* is formed in the semispherical head 110*b*. As in the embodiment shown in FIG. 10, a tab 112 has a vertical leg 112*a* and a rectangular foot 112*b* extending horizontally from the lower end of the leg 112*a* and having a circular opening 112*c*. The maximum outer diameter of the semispherical head 110*b* is slightly greater than the inside diameter of the opening 112*c*. With this arrangement, the semispherical head 110*b* is inserted through the opening 112*c* so that the neck portion 110*c* is located in the opening 112*c*. The lower end of the round base 110*a* is secured to the cover plate (not shown in FIG. 11) in the same manner as in the embodiment shown in FIGS. 1 to 4. All the insulative elements in the embodiments shown in FIGS. 8 to 11 are made of a material with a low degree of heat conductivity, such as epoxy resin, phenolic resin, polyester resin and acrylic resin.

The present invention has been described with respect to its preferred embodiments, it is to be understood that various modifications and changes may be made without departing from the scope of the invention as defined by the appended claims.

What is claimed is:

1. A cover assembly for a concealed sprinkler head, said concealed sprinkler head being mountable within the ceiling of a fire protected enclosure and including a cylindrical housing, said cover assembly comprising:

a metallic cover plate mountable substantially flush with the ceiling to conceal the sprinkler head within the ceiling, said cover plate being made of a heat conductive material;

a metallic skirt including a substantially cylindrical wall, an annular flange extending outwardly from one end of the cylindrical wall, and a plurality of tabs extending generally downwardly from said flange, said cylindrical wall of said skirt being adapted to be connected to the cylindrical housing of the sprinkler head;

a plurality of heat insulative elements having upper and lower surfaces, said upper surface of each of said insulative elements being secured to a corresponding one of said tabs;

a metallic layer attached to the lower surface of each of said insulative elements; and a layer of fusible material disposed between said metallic layer and said cover plate to secure each of said insulative elements to said cover plate through said metallic layer.

2. The cover assembly of claim 1, wherein said upper surface of each of said insulative elements is secured to a corresponding one of said tabs by an adhesive.

3. The cover assembly of claim 1, wherein said metallic layer is made of copper.

4. The cover assembly of claim 1, wherein said metallic layer is made of copper alloy.

5. The cover assembly of claim 1, further comprising a protective layer made of a water resistant material and surrounding said layer of fusible material, said metallic layer, each of said insulative elements, and each of said tabs.

6. The cover assembly of claim 5, wherein said protective layer is made of wax.

7. The cover assembly of claim 1, further comprising a second metallic layer attached to the upper surface of each of said insulative elements, and a second layer of fusible material disposed between said second metallic layer and said corresponding one of said tabs so as to secure said insulative element to said tab.

8. The cover assembly of claim 7, wherein said first layer of fusible material has a lower melting point than said second layer of fusible material.

9. The cover assembly of claim 7, wherein said first layer of fusible material has substantially the same melting point as the second layer of fusible material.

10. The cover assembly of claim 7, wherein said first and second metallic layers are made of copper.

11. The cover assembly of claim 7, wherein said first and second metallic layers are made of copper alloy.

12. The cover assembly of claim 7, further comprising a protective layer made of a water resistant material and surrounding said first and second layers of fusible material, said first and second metallic layers, each of said insulative elements, and each of said tabs.

13. The cover assembly of claim 12, wherein said protective layer is made of wax.

14. The cover assembly of claim 1, wherein each of said tabs has a substantially vertical leg with an upper end connected to said flange and a lower end, and a foot extending outwardly from the lower end of said leg, and each of said insulative elements includes a rectangular plate and opposite side walls extending upwardly from opposite sides of said plate, said insulative elements having a space between said plate and said side walls to receive said foot of said tab.

15. The cover assembly of claim 1, wherein each of said tabs has a substantially vertical leg with an upper end connected to said flange and a lower end, and a foot extending outwardly from the lower end of said leg and having a recess, and each of said insulative elements includes a plate and a projection formed on said plate, said projection being engageably received within said recess to secure said insulative element to said tab.

16. The cover assembly of claim 1, wherein each of said tabs has a substantially vertical leg with an upper end connected to said flange and a lower end, and a foot extending outwardly from the lower end of said leg and having a substantially circular opening, and each of said insulative elements includes a substantially cylindrical shank and a head connected to one end of said shank, said shank being fit in said opening to secure said insulative element to said tab.

17. The cover assembly of claim 1, wherein each of said tabs has a substantially vertical leg with an upper end connected to said flange and a lower end, and a foot extending outwardly from the lower end of said leg and having a substantially circular opening, and each of said insulative elements includes a base, and a substantially semispherical head connected to said base and having a slit, said head being inserted through said opening to secure said insulative element to said tab.

* * * * *